US007681733B2

(12) United States Patent
Grosskopf

(10) Patent No.: US 7,681,733 B2
(45) **Date of Patent: *Mar. 23, 2010**

(54) PACKAGING CONTAINER WITH CRISS-CROSS GRAIN PATTERN HAVING PRODUCT HOLDING CHAMBERS AND METHOD FOR MAKING THE SAME

(75) Inventor: Glenn A. Grosskopf, Lake Zurich, IL (US)

(73) Assignee: Colbert Packaging Corporation, Lake Forest, IL (US)

( * ) Notice: Subject to any disclaimer, the term of this patent is extended or adjusted under 35 U.S.C. 154(b) by 234 days.

This patent is subject to a terminal disclaimer.

(21) Appl. No.: 11/380,159

(22) Filed: Apr. 25, 2006

(65) Prior Publication Data

US 2007/0187273 A1 Aug. 16, 2007

Related U.S. Application Data

(63) Continuation-in-part of application No. 10/651,815, filed on Aug. 28, 2003, now Pat. No. 7,051,876.

(60) Provisional application No. 60/406,779, filed on Aug. 29, 2002.

(51) Int. Cl.
*B65D 73/00* (2006.01)
*B65D 83/04* (2006.01)

(52) U.S. Cl. ..... 206/462; 206/469; 206/532; 229/940

(58) Field of Classification Search ..... 206/461–463, 206/471, 557–559, 565; 428/511
See application file for complete search history.

(56) References Cited

U.S. PATENT DOCUMENTS 1,011,697 A * 12/1911 Witkowski ..... 206/462
1,816,542 A 7/1931 Mellin
3,184,319 A * 5/1965 Fritsche ..... 206/462

(Continued)

FOREIGN PATENT DOCUMENTS

AU PL1153 9/1993

(Continued)

OTHER PUBLICATIONS

International Preliminary Report on Patentability in relation to PCT/US07/67430.

*Primary Examiner*—Bryon P Gehman
(74) *Attorney, Agent, or Firm*—Patzik, Frank & Samotny Ltd.

(57) ABSTRACT

A packaging container for displaying and housing products that is aesthetically pleasing, effective and safe to open. The packaging container may include a substantially tear-resistant housing that encloses a tray that is preferably made from a paper material. The tray is substantially opaque to display graphics and/or to prevent viewing of the contents. The tray is preferably seamless such that it may not be opened without scissors, a knife or the like and, when opened, such opening is readily apparent. A second tray may also be used to create a dual-sided tray for housing the products, wherein the second tray may be substantially opaque or substantially transparent. An insert card may be used within the housing to reinforce the container and may be contained by fold-over edges of the housing.

24 Claims, 12 Drawing Sheets

U.S. PATENT DOCUMENTS

| | | | | | |
|---|---|---|---|---|---|
| 3,255,870 | A | * | 6/1966 | Peck | 206/461 |
| 3,394,802 | A | * | 7/1968 | Hershaft | 206/461 |
| 3,497,059 | A | | 2/1970 | Watts, Jr. | |
| 3,657,857 | A | * | 4/1972 | De Woskin et al. | 206/463 |
| 3,792,809 | A | | 2/1974 | Schneider et al. | |
| 4,328,254 | A | * | 5/1982 | Waldburger | 206/558 |
| 4,354,598 | A | | 10/1982 | Schillinger | |
| 4,609,140 | A | | 9/1986 | Van Handel et al. | |
| RE32,270 | E | | 10/1986 | Murray, Jr. | |
| 4,981,213 | A | | 1/1991 | Dillon | |
| 5,091,261 | A | | 2/1992 | Casey et al. | |
| 5,116,649 | A | | 5/1992 | Massouda | |
| 5,119,952 | A | * | 6/1992 | Warriner, Jr. | 206/462 |
| 5,240,110 | A | * | 8/1993 | Reichenbach et al. | 206/462 |
| 5,379,886 | A | * | 1/1995 | Brauner et al. | 206/462 |
| 6,010,784 | A | | 1/2000 | Peterson | |
| 6,093,460 | A | | 7/2000 | Iwaya | |
| 6,230,964 | B1 | * | 5/2001 | Saito | 206/462 |
| 6,491,214 | B2 | | 12/2002 | Plummer et al. | |
| 6,676,584 | B2 | * | 1/2004 | Tachikawa et al. | 206/462 |
| 7,144,635 | B2 | | 12/2006 | Hawes et al. | |
| 7,192,640 | B2 | | 3/2007 | Holbert et al. | |
| 2002/0050119 | A1 | | 5/2002 | Gatewood et al. | |
| 2006/0016717 | A1 | | 1/2006 | Ritter | |
| 2009/0152333 | A1 | | 6/2009 | Maeaettae et al. | |

FOREIGN PATENT DOCUMENTS

| | | | |
|---|---|---|---|
| GB | 2123786 | A | 2/1984 |
| GB | 2218072 | B | 4/1992 |
| WO | 93/23294 | A1 | 11/1993 |
| WO | 95/35204 | A1 | 12/1995 |

* cited by examiner

PACKAGING CONTAINER WITH CRISS-CROSS GRAIN PATTERN HAVING PRODUCT HOLDING CHAMBERS AND METHOD FOR MAKING THE SAME

This application is a continuation-in-part of U.S. patent application Ser. No. 10/651,815, filed Aug. 28, 2003, now U.S. Pat. No. 7,051,876, which claims priority to U.S. Provisional Patent Application Ser. No. 60/406,779, filed on Aug. 29, 2002 and PCT Application Serial No. PCT/US 2002/31224, filed on Oct. 1, 2002.

FIELD OF THE INVENTION

This invention relates in general to packaging containers and, more particularly, to packaging containers having one or more chambers formed from printable trays, being opaque or otherwise, for housing products.

BACKGROUND OF THE INVENTION

Heretofore, it has been well known to use clamshell packaging for labeling and housing various products. Clamshells are generally comprised of a housing and a chamber for storing products and may be reusable or permanently sealed. Permanently sealed clamshells are generally formed from a clear plastic housing that is sealed together through radio frequency (RF), sonic vibrations or electrical resistance. As the housing is generally made from clear plastic, inserts made of cardboard and other materials are often inserted into the clamshell packaging to describe or label the goods. Furthermore, products within the packaging may be further packaged to enhance the overall appearance of the package.

While permanently sealed clamshells offer increased protection from pilfering, there are several drawbacks associated with the use of such clamshells. In particular, the processes for inserting an insert and for sealing the clamshell together are generally expensive and time consuming. Moreover, in order to hold the larger quantities of products in the "institutional" or "value" packages normally sold in warehouse clubs and the like, and/or to make such packages harder to shoplift, such large all-plastic clamshells tend to take up a greater amount of shelf space than necessary, use up more packaging material than necessary to make the package, and result in a greater amount of wasted packaging material. It is also common for the products to be further packaged inside the clamshell packaging, thereby requiring additional material, incurring additional cost and creating a larger overall package.

Such sealed all-plastic clamshells also tend to be harder to open by the consumer (after purchase) than other sorts of packaging. Additionally, such plastic packaging is typically rigid, whereby a knife or scissors being used to open the package by penetrating the plastic clamshell can bounce or slip off the package and cut or otherwise wound the user or someone situated adjacent the user. When cut open, the plastic housing often has sharp edges that can pose a risk to the user and/or young children. Furthermore, the plastic housing of the known packaging are not biodegradable or environment-friendly.

Another common type of container incorporates an opaque box to store goods or products so that they are not visible to the consumers or others. Such boxes are typically made from a cardboard or heavy stock paper having sides comprised of flaps. In order to seal the boxes, the flaps of the box are adhered to one another. The box is, therefore, opened by pulling one flap apart from the other flaps of the box. While these boxes may, in many respects, work, problems have arisen with respect to their use. In particular, because of the way that the boxes are opened and closed, the edges of the flaps are not perfectly flush with the box. Accordingly, the edges may be torn and/or inadvertently opened if the packaging is contacted against a sharp surface or other object. Having opened or partially opened boxes may result in additional costs and expenses to the storeowner or seller because consumers are less likely to buy goods that appear to have been tampered with or damaged. Many cartons are also housed in a clear plastic clamshell to inhibit theft, which results in a higher cost per piece and a larger package (thus more shelf space).

Additionally, because these boxes may be readily opened by opening a flap along their exposed seams, the products are susceptible to pilfering and such pilfering is not always immediately detectable. The potential problem with pilfering of products, such as razorblades, has forced many stores to remove the products from the general store shelves and instead place such products behind the counters. Accordingly, both the customers and employees are inconvenienced by the fact that the products must be specifically requested by the customers and retrieved by an employee in order to purchase them.

Therefore, there is a need to produce a packaging container that allows for a retailer to describe or label the product, while being aesthetically pleasing, economical, easy to manufacture and sized to take up a minimum amount of shelf space.

SUMMARY OF THE INVENTION

The present invention is an improvement over the prior product packaging in the way that the tray and housing interact to form the product packaging and in the types of materials used in the product packaging. In particular, the housing includes one or more openings to accommodate one or more trays for storing the product(s). Each of the trays has a chamber and a flange that extends around the bottom of the chamber so that when the chamber is inserted through the opening in the housing, the flange abuts with the underside of the top or bottom half of the housing to prevent the tray from being pulled through the opening.

In one embodiment, the layers of the card material for the housing are overlapped so as to criss-cross the grain of the overlapped layers used. Accordingly, the housing is resistant to tearing in two directions instead of only one. The housing also is preferably printable to allow for advertising, promotional or other information to be displayed.

The product tray is preferably opaque or substantially opaque and made from a material that is printable. In one embodiment, the tray is made from a flat blank that is printed on and then formed into the desired tray shape. In order to increase the rigidity of the package and to facilitate stacking, flutes may be added to encircle the chamber of a tray such that they will be located in an area within the opening of the housing to enhance the rigidity of the material and to give the impression that the material is difficult to cut.

The material for the tray may also be substantially tear-resistant. In order to further protect against theft, the tray is preferably substantially seamless and may have reinforced corners, if corners are present. Such seams or exposed tape present on conventional packaging (which makes them prone to pilferage) can thus be avoided. A security device such as an electronic device sensor may also be placed within the product packaging to inhibit anyone from stealing the whole package.

The package may also include multiple trays. In order to permit certain non-aesthetic or unattractive features of the products contained within the package from being displayed, it is appreciated that, in the case of a double or multiple tray package, one of the trays may be opaque or substantially opaque and the other tray may be substantially transparent. The trays may also all be opaque or substantially opaque to prevent the package's contents from being viewed.

In the case of the substantially transparent tray, the tray may be, among other things, a single large plastic compartment or multiple plastic compartments, and is preferably secured within the housing by the overlapping layers of the card portion. Thus, once in place, the products are securely contained within and visible through only one side of the housing.

In another embodiment, a pair of trays having a reinforced layer material and a heat seal coating therebetween may be placed together with their open storage chambers facing each other to house a product. The flanges or rims of the trays may then be heat sealed together.

The trays may also be designed to permit them to be stacked for storage and/or shipping. In one embodiment, the chamber of the tray includes side walls that are angled inwardly and a substantially flat top wall to permit multiple trays to be placed on top of one another. In order to reinforce the packaging to, among other things, prevent damage to the packaging during the stacking process, a single sided corrugate, e-flute or other rigid member may be adhered to one or both of the halves of the housing. A heat seal coating is preferably placed on the other side of the corrugate to allow the corrugate to be beat sealed to the other side of the housing to form a reinforced package. Ribs may also be added to the tray to provide for additional strength and to facilitate the stacking process.

A reinforced insert card made of corrugate or chip board also may be placed between the housing halves or members to provide added strength to the package. In order to inhibit the tearing open of the package, a substantially tear-resistant material such as VALERON™ may be laminated or otherwise attached or adhered to one or both sides of the insert card.

It is therefore an object of the present invention to provide a new packaging container wherein the housing is manufactured from a printable material that may be substantially tear-resistant.

A further object of the present invention is to provide a new packaging container having a printable substantially opaque tray.

Still another object of the present invention is to provide a new packaging container that eliminates the need to wrap or further package products within the package.

Yet another object of the present invention is to provide a new packaging container that is good for the environment.

Still another object of the present invention is to provide a new packaging container that is safer to open.

Another object of the present invention is to provide a packaging container for displaying products or product information that is substantially tear-resistant.

Yet another object of the present invention is to provide a packaging container that inhibits theft and the inadvertent opening of the packaging.

Still another object of the present invention is to provide for trays for packaging containers that facilitate stacking.

A further object of the present invention is to provide a packaging container that is easy and economical to manufacture.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
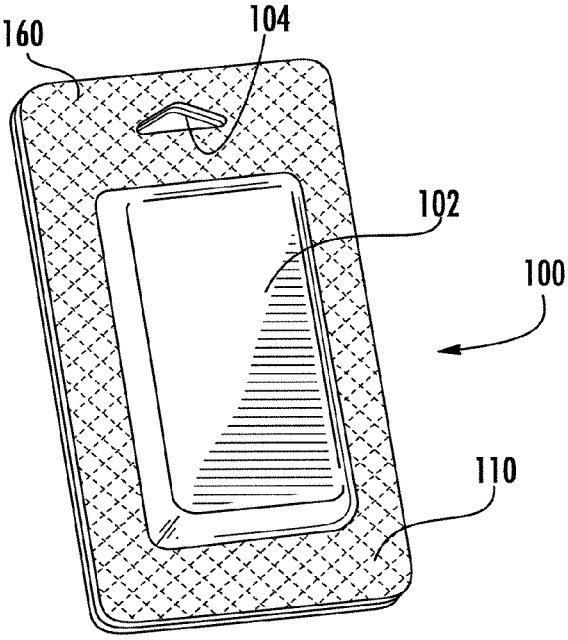
FIG. 1 is a perspective view of an embodiment of a clamshell package having a central tray.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
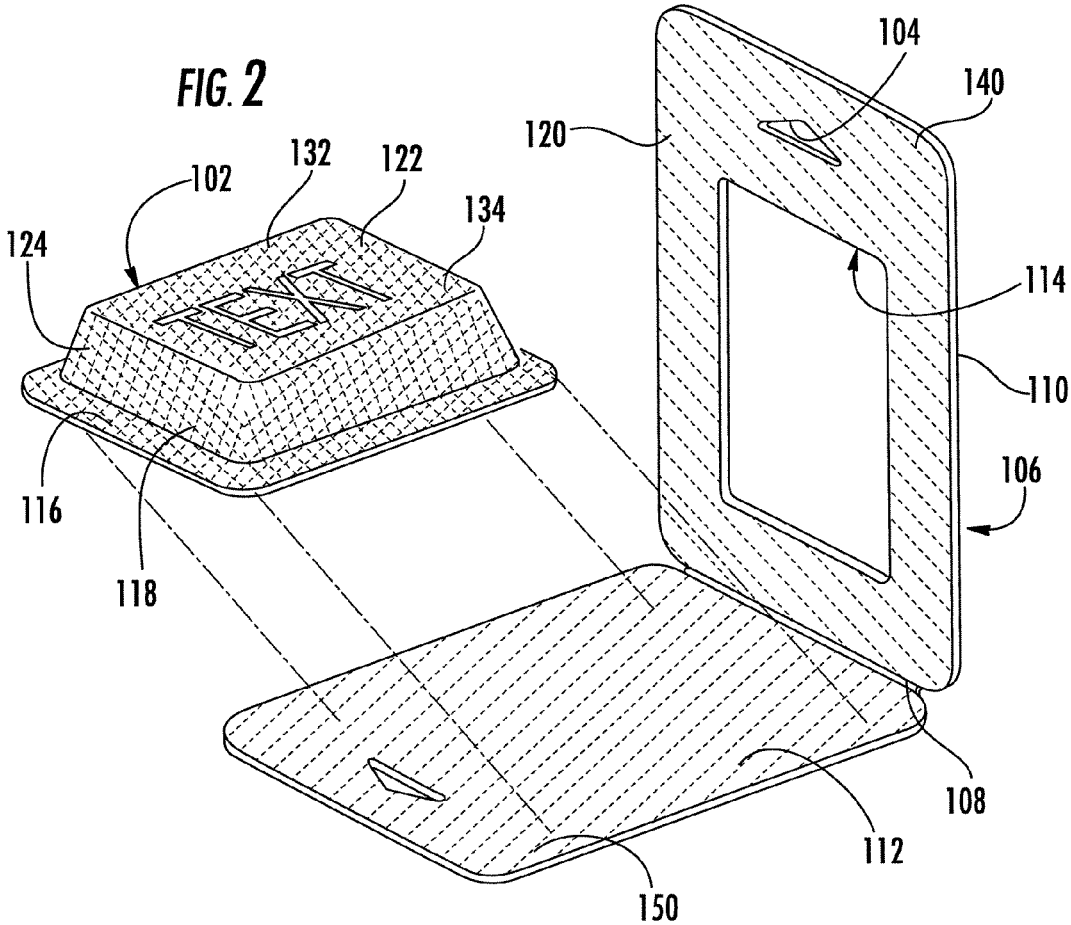
FIG. 2 is an exploded view of the clamshell package showing the housing bottom sheet rotated away from the housing top sheet and the central, single rectangular tray having a flange to be securely retained between the top and bottom sheets when attached.

Referring now to the drawings, and particularly to FIGS. 1 and 2, the improved product packaging of the present invention, generally designated by the numeral 100, is shown having a housing 106 and a tray 102 having a chamber for storing the product. While a box-shaped chamber or a chamber having angled sides is shown and disclosed, it is appreciated that the present invention may be used with any number of trays of any known size and shape and with any number of different types of packaging for products and not depart from the scope of the invention.

The housing may be made from a SBS board coated on one side with a laminated material having directional grains so that when two housing sheets having grains 140 and 150 are placed on top of one another such that the grains overlap, the criss-crossing grains 160 of the materials adds strength to the housing and protects against tearing or tampering in two directions. A suitable coating is manufactured under the trademark VALERON™. by Valeron Strength Films. While VALERON is made from a polyethylene material, other such coatings such as, but not limited to, polypropylene or polyester may be used. The material used also is preferably printable to allow for advertising, promotional or other information to be displayed on the housing. While a SBS board with a cross-laminated coating is preferred, it is appreciated that other materials having single or multi-directional grains or sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF. A corrugate stock also may be used to achieve a more rigid product.

As shown in FIG. 2, the housing 106 is preferably made from a single sheet of material having a scored line 108 to facilitate the folding of the top half 110 onto the bottom half 112 of the sheet to form the product packaging 100. While the housing is shown as being formed from a single sheet, it is appreciated that it may be formed from two or more sheets that are then laminated, affixed or otherwise secured or placed together. The top sheet 110 of the housing of the packaging includes an opening 114 sized to accommodate a tray 102 for storing products or other materials such as labels (not shown) or the like. The opening may be of any shape or size to accommodate a suitable tray. Furthermore, it is appreciated that the housing may have any number of openings to accommodate a number of trays and not depart from the scope of the present invention.

Figure 9:
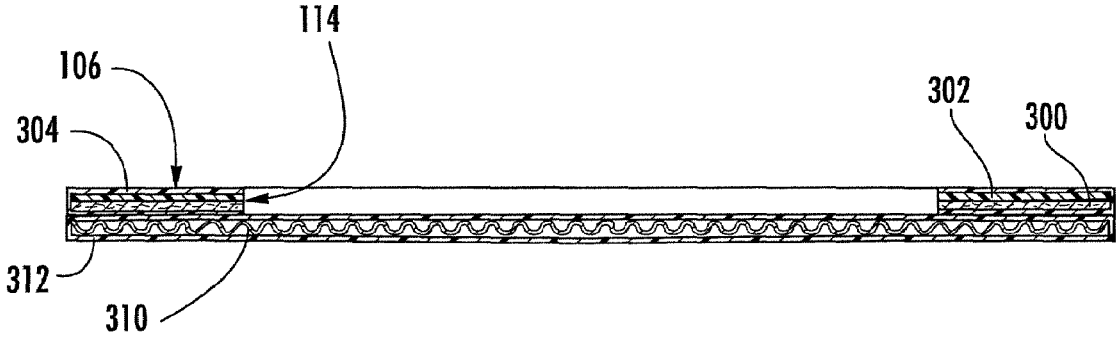
FIG. 9 is a sectional view of an embodiment of a housing for the packaging container.

In another embodiment shown in FIG. 9, the housing is made from a pair of paper or board products. A first layer 300 such as, but not limited to SBS board, recycled board, cardboard or other board stock paper or a combination thereto may be coated with a tear-resistant material 302 such as, but not limited to, VALERON, PLA (corn oil plastic) or any supporting film or material. A heat seal coating 304 may then be extruded or laminated onto the first layer. A second layer 310, which may comprise a single-faced or double-faced corrugate, e-flute or a chip board stock layer may then have a heat seal coating 312 extruded or laminated thereon. This construction adds to the rigidity and stackability of the packages. In addition to being laminated together, it is appreciated that the layers may be attached together using any of the known means including, but not limited to, using glue or adhesive. It is further appreciated that the housing may be made without a tear resistant coating.

Figure 10:
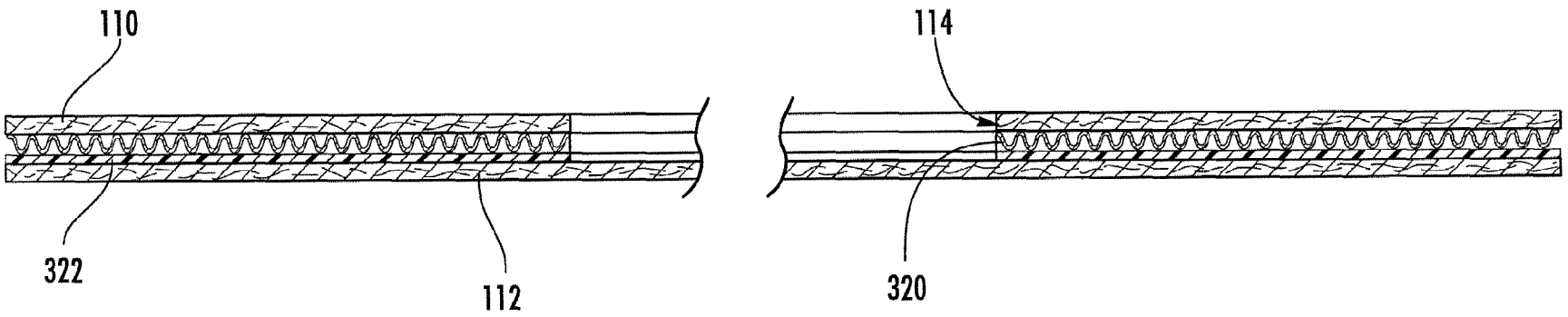
FIG. 10 is a sectional view of another embodiment of a housing for the packaging container.

Referring now to FIG. 10, the housing may also comprise a single sided corrugate or e-flute 320 affixed or adhered to one or both sides of one of the housing sheets or members 110, 112. It is appreciated that instead of adhering or affixing to one or both sides of the housing, an insert such as, but not limited to, a corrugate, chip board or e-flute may be placed between the housing sheets or members, wherein the insert will be held in placed once the housing sheets or members are attached or affixed together (e.g., by heat-sealing). Where a corrugate is adhered to only one side, it is preferred that the corrugate 320 include a heat seal coating 322 on the liner side to permit the corrugate 320 to be heat sealed to the other housing sheet or member. While a single sided corrugate is shown and disclosed, it is appreciated that other known materials may be used to reinforce the packaging including, but not limited to, a chip board stock. It is appreciated that the corrugate may be coated with a substantially tear resistant material such as, but not limited to, VALERON. While a single sided corrugate with a cross-laminated coating may be used in one embodiment, it is appreciated that other materials having sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF. It is appreciated that the corrugate or insert may be used in connection with a standard housing (e.g., a housing made of standard board materials such as recycle board or SBS sheets) or a tear resistant housing and not depart from the scope of the present invention.

Figure 11:
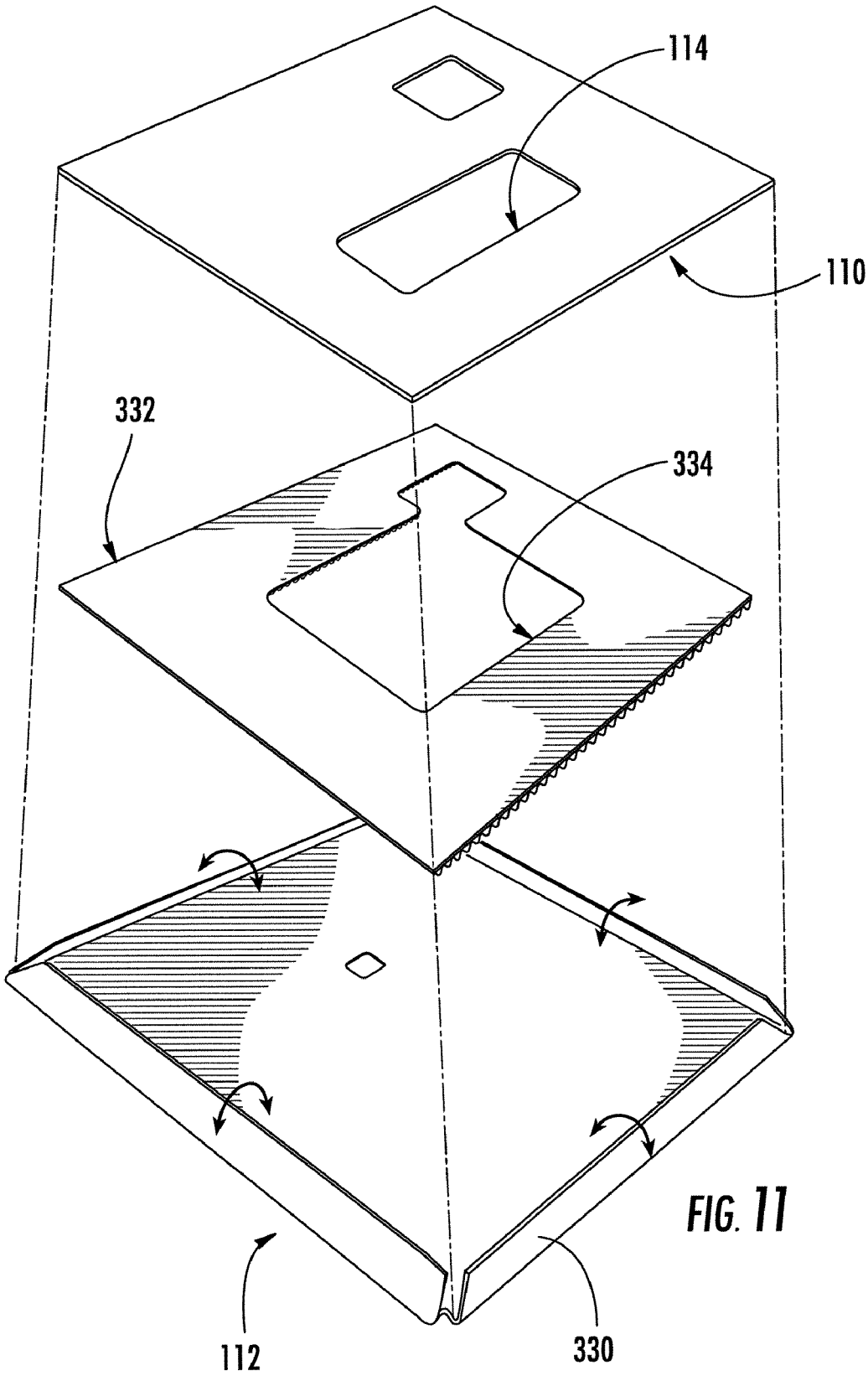
FIG. 11 is an exploded perspective view of an embodiment of a housing for the packaging container having an insert card.

In order to enhance the aesthetics of the packaging and to further prevent tampering, as shown in FIG. 11, it is appreciated that one of the housing sheets 110, 112 may include edge members 330 that may be folded over to secure an insert card 332 (e.g., a single sided corrugate, e-flute or chip board stock) thereto. The insert card 332 may be coated with a substantially tear resistant material such as, but not limited to, VALERON on one or both of its sides. While a SBS board with a cross-laminated coating may be used in one embodiment, it is appreciated that other materials having sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF. In one example of the assembly, the insert card 332 is placed on top of the inside of the bottom sheet 112 of the housing 106. The edge members 330 of the bottom sheet 112 may then be folded on top of the insert card 332. Preferably, the edge members 330 are shaped so that they form a substantially contiguous surface area when folded over. A tray may then be placed on top of the insert card 332 (or may be placed before the insert card is inserted to extend through an opening 334 in the insert card 332). The top sheet 110 of the housing 106 may then be placed on top of the bottom sheet 112 so that the chamber of the tray extends through an opening 114 in the top sheet 110. The top and bottom sheets 110, 112 may then be heat sealed together or otherwise attached as previously described. By folding over the edge members, the packaging thus creates a more aesthetically attractive appearance by concealing the insert card from view, while also increasing protection against tampering and the strength of the edges.

The chamber of the tray 102 preferably extends outward from the housing sheet in order to house the product or label and is preferably made of a substantially opaque material to enable the contents inside the tray to be at least substantially hidden from view. This opaque tray would be well suited for a product that is small, unattractive or otherwise unsuitable or undesired for display or of little interest to the consumer. Attractive graphics and/or product information could thus be used on the tray as well. It is further appreciated that the interior chamber of the tray may be sized and shaped to facilitate the stacking of multiple yet to be used trays during the manufacturing process. While the tray shown and disclosed includes a chamber that has angles incorporated into the walls 124 of the chamber and a flat top wall 122 to permit, among other things, multiple trays to be nested, it is appreciated that the chamber and tray may be of any known shape and size and not depart from the scope of the present invention. For example, it is appreciated that the chamber may be substantially box-shaped and not depart from the scope of the present invention.

While the material for the tray may be made from a wide variety of materials, it is preferred that the material be of the type known to protect against tearing or tampering. The tray thereby acts to prevent consumers from seeing the product, as well as preventing undesired removal of the product from the package prior to purchase. An example of such a material is a SBS board coated on both sides (or multiple coating on the same side) with a material having a directional grain such as VALERON™ such that the grains criss-cross to add strength to the tray. It is also appreciated that the tray may comprise two layers of SBS board that are coated with a laminated material having directional grains so that when the two layers are placed on top of one another such that the grains 132, 134 overlap in a criss-cross fashion. The criss-cross grains of the material add strength to the tray and protect against tearing or tampering in two directions. A suitable coating is manufactured under the trademark VALERON™ by Valeron Strength Films. While VALERON is made from a polyethylene material, other such coatings such as, but not limited to, polypropylene or polyester may be used. Another example of a suitable coating or laminate is PLA (corn oil plastic).

While a SBS board with a cross-laminated coating is preferred, it is appreciated that other materials having sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF.

Figure 6:
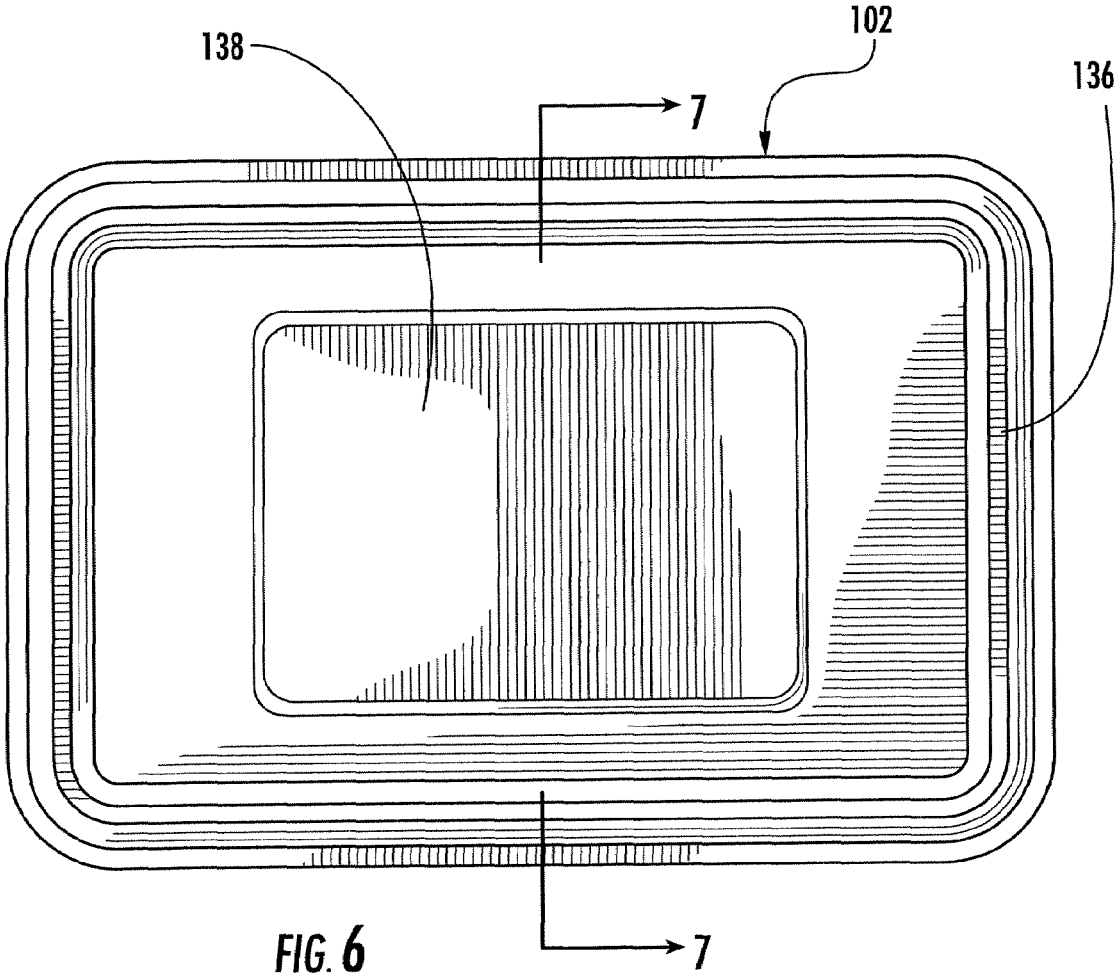
FIG. 6 is a top view of one embodiment of a tray of the present invention.
Figure 7:
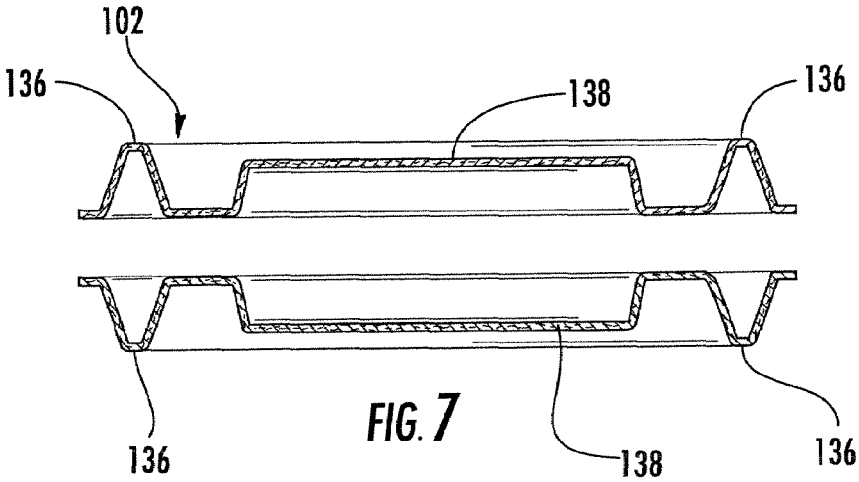
FIG. 7 is a side view of the tray of FIG. 6 with another tray of the present invention aligned beneath it.

Various forms of paper products, such as one or multiple layers of heavy stock paper, cardboard or recycled paperboard having sufficient strength to house the products may also be used. For heavier items, it is appreciated that stronger material such as corrugated paper may be used and not depart from the scope of the present invention. It is also appreciated that e-flute or other fine corrugate material may be used. In one embodiment, the paper product may comprise an SBS board, recycled board or other board stock product. Referring now to FIGS. 6 and 7, the tray may comprise a main chamber area 138 and one or more flutes 136 extending around the chamber in an area within the opening of the housing to enhance the rigidity of the material and to give the impression that the material is difficult to cut. The tray may be attached to another tray as shown in FIG. 7 to form a packaging container having a larger holding area or to a sheet or other material to close off the open end of the chamber. The flutes may also facilitate stacking of the trays. In one embodiment, when stacked in multiple vertical layers of products, the bottom layer withstands pressure of at least 1500 pounds when stacked. A heat seal coating may also be extruded or laminated onto the liner side of the chamber or the blank to facilitate assembly of the packaging. It is appreciated that the heat seal coating may be used in connection with or separate from the substantial tear-resistant material.

Figure 3:
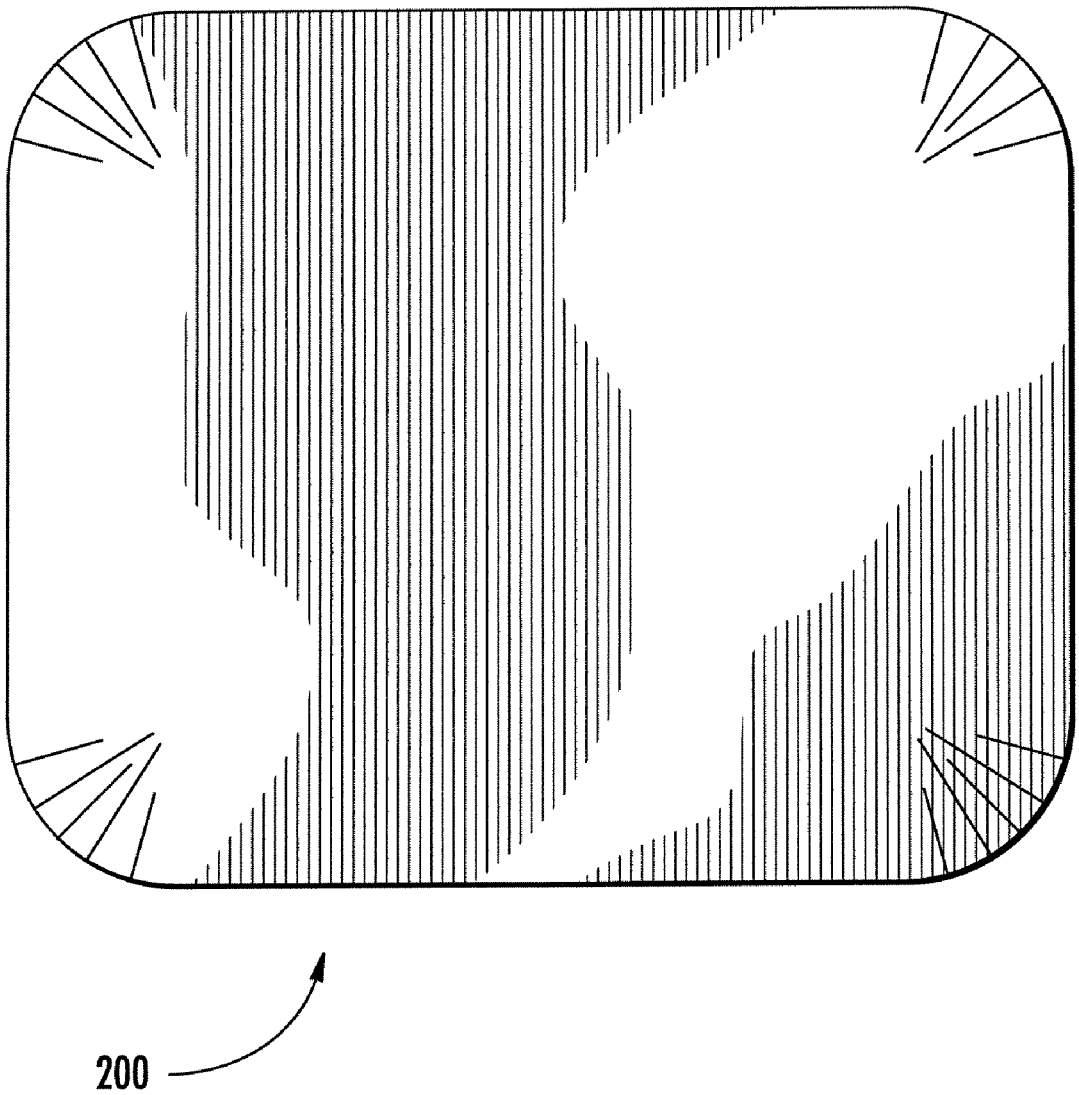
FIG. 3 is a top view of a blank for forming into a tray.
Figure 4:
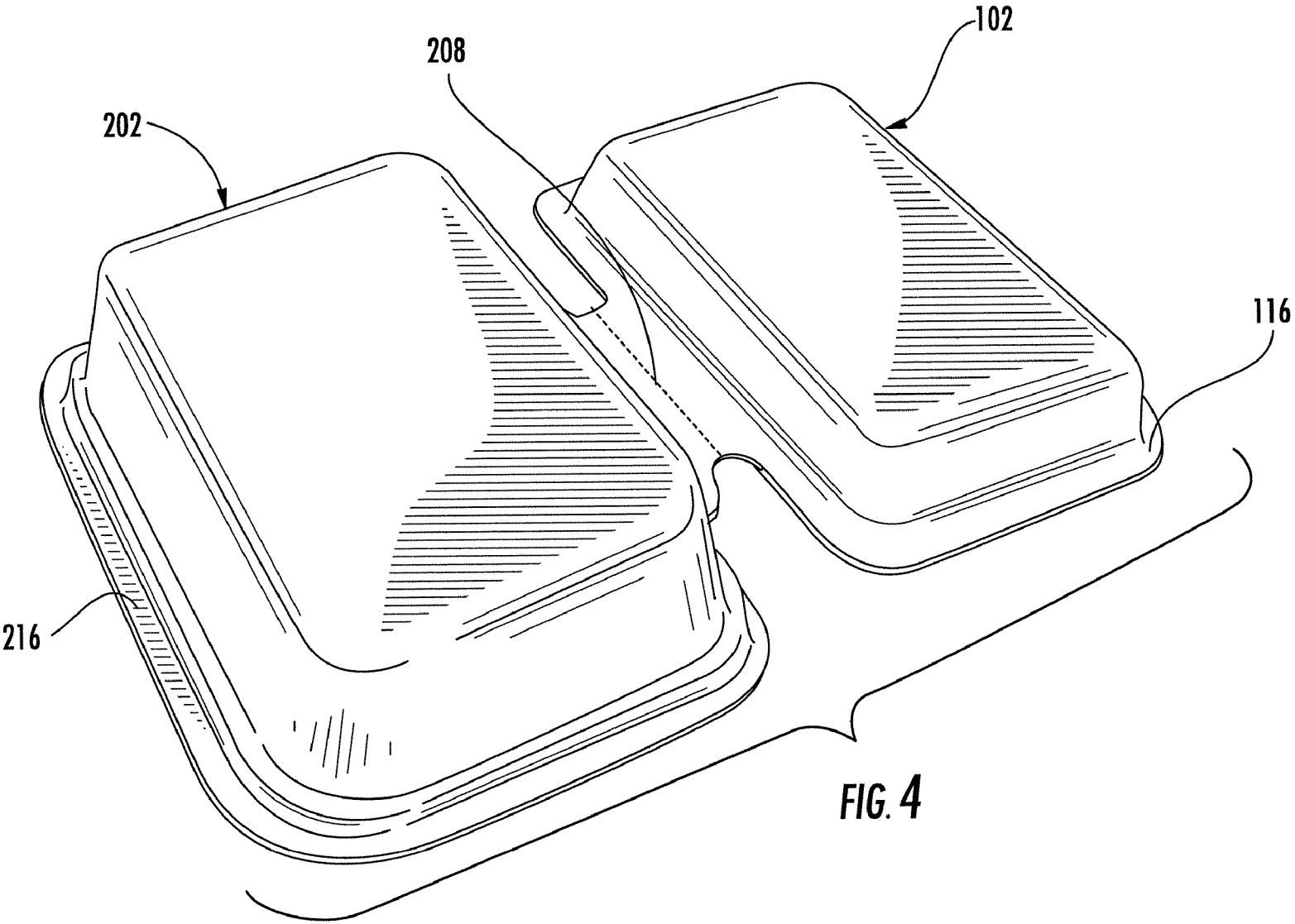
FIG. 4 is a perspective view of a pair of trays.

Referring now to FIG. 3, the tray 102 may be formed from a blank 200 of material that is preferably printable to allow for advertising, promotional or other information to be displayed on the tray. In the preferred embodiment, the step of printing on the tray may be performed prior to stamping or otherwise forming the tray from the blank. As shown in FIG. 2, the formed tray 102 may then be placed so as to be sandwiched between the two housing halves 110 and 112, so that the walls 124 of the chamber of the tray 102 extend through the opening 114 while being retained by the top half 110 of the housing.

To prevent objects from tampering with or damaging the package 100, and to prevent the tray 102 from being pulled through the opening 114, it is preferred that the chamber of the tray 102 be sized to fit snuggly within the opening 114 so that the sheet 110 of the housing 106 substantially surrounds the perimeter of the open end of the chamber. In order to secure the tray 102 within the housing 106, a flange 116 may extend around the bottom or open end 118 of the chamber such that when the chamber of the tray 102 is inserted through the opening 114, the flange 116 abuts with the underside 120 of the top half 110 of the housing 106 to prevent the tray 102 from being pulled through the opening 114. While a contiguous flange is shown in the figures, it is appreciated that the chamber may be retained between sheets 110 and 112 by a non-contiguous flange, a series of tabs or other suitable means such as adhesives and/or staples and the like (not shown).

In order to further assist in the prevention of theft of the package 100 and its contents, the interconnection between the walls 124 of the chamber are preferably substantially seamless. Accordingly, unlike the known product packages, the walls will not tend to separate or be easily separated by the consumer to facilitate the unwanted opening of the chamber and removal of the contents—before purchase of the product. Additionally, the corners (if any) and/or sides of the chamber may be reinforced to further prevent any tampering with the chamber or its contents. Examples of chambers having reinforced corners and sides include, but are not limited to, chambers having their edges reinforced with fiber-reinforced tape or a fiber laminate, similar to a set-up box.

Figure 5:
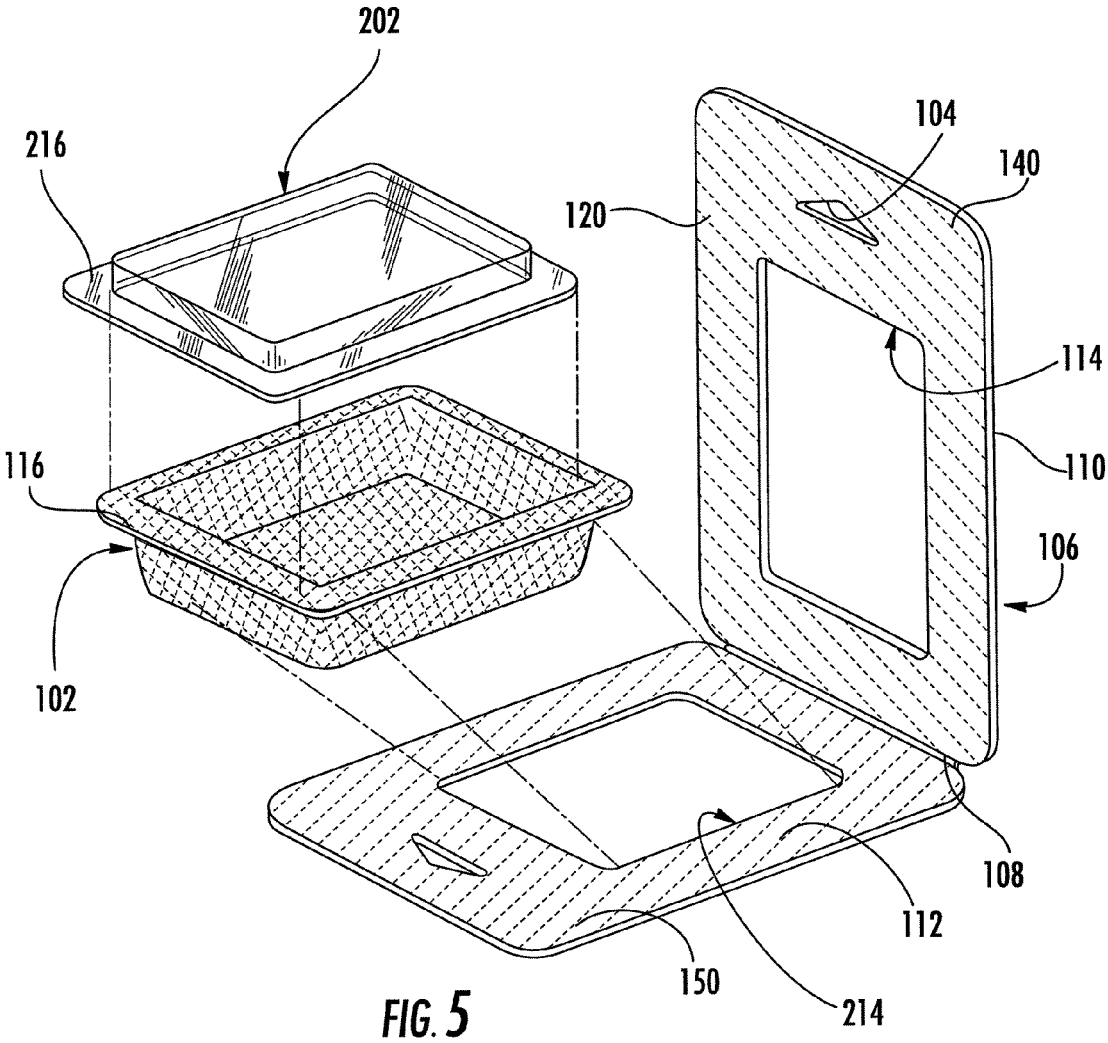
FIG. 5 is an exploded view of a packaging container showing the housing bottom sheet rotated away from the housing top sheet and a pair of trays for securing within the housing.

Referring now to FIG. 5, another embodiment of the present invention is shown wherein the packaging 100 comprises a dual tray constriction with a top tray 202 for extending through the opening 114 in the top half 110 of the housing 106 and a bottom tray 102 for extending through an opening 214 in the bottom half 112 of the housing 106. It is appreciated that the bottom and top trays may be made of a variety of shapes and sizes depending on the desired package configuration and the size and shape of the products to be packaged within the container. To prevent objects from tampering with or damaging the package, it is preferred that the top and bottom trays have chambers sized to fit snuggly within their respective opening so that the sheet of the housing substantially surrounds the perimeters of the open ends of the chambers of the trays. For example, in order to secure the top tray 202 within the housing, a flange 216 may extend around the bottom or open end of the chamber of the top tray 202 such that when the chamber of the top tray 202 is inserted through the opening 114 from behind, the flange 216 abuts with the underside of the top half 110 of the sheet to prevent the tray 202 from being pulled through the opening 114. Similarly, in order to secure the bottom tray 102 within the housing, a flange 116 may extend around the bottom or open end of the chamber of the bottom tray 102 such that when the bottom chamber is inserted through the opening 214, the flange 116 abuts with the underside of the bottom half 112 of the housing to prevent the tray 102 from being pulled through the opening 214. While a contiguous flange is shown as being used on the top and bottom trays, it is appreciated that either tray may be retained by a contiguous flange, a non-contiguous flange, a series of tabs or other suitable means such as adhesives and/or staples and the like.

It is appreciated that the trays 102, 202 may be formed connected together at one side so that the trays may be rotated together about a scored line 208 to form a dual-sided tray, or the trays may be separate and placed together with the open tray chambers being placed face-to-face to form the dual-sided tray or aligned with separate openings in the bottom half 112 or the top half 110 of the housing to form two separate trays. It is further appreciated that when the trays are placed together in face-to-face arrangement to form a dual-sided tray, both trays may be substantially opaque, or, if it is desired to show one side of the product(s) in the packaging, as shown in FIG. 5, one of the trays may be made of a substantially transparent material such as, but not limited to PVC.

With the chambers of the trays 102, 202 inserted into their respective openings 114, 214, one or more products or labels may be placed within the trays for storage or, if a substantially transparent tray is used, in the proper orientation for display. The two housing halves 112, 114 or portions are then closed together about the scored line 108 and securely affixed. The two halves are preferably affixed together using a heat-sealed adhesive, although it is appreciated that other types of adhesives or attaching means may be utilized and not depart from the scope of the present invention.

The packaging 100 may also include a hole or slot 104 at the upper end of the packaging or elsewhere that is sized to enable the packaging to be placed onto a display or store shelves using a rod or peg board hook (not shown) at the point of sale for sale or display. Because of the cross sectional characteristics of the housing, the hole is reinforced to prevent tearing or manipulation.

Figure 12:
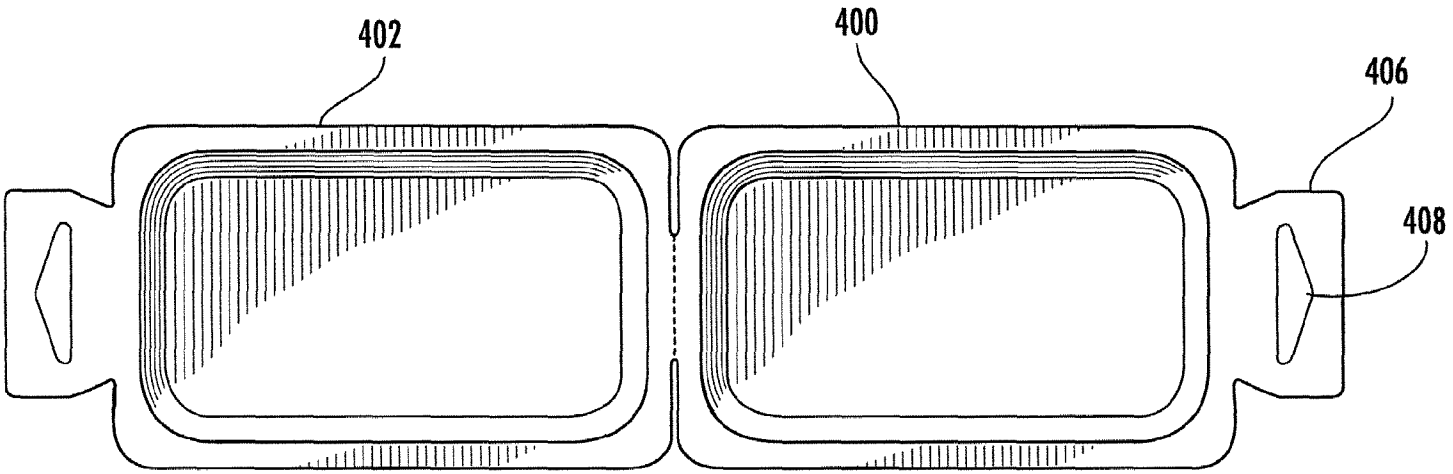
FIG. 12 is a top plan view of an embodiment of a packaging container having a pair of hingedly-connected trays.
Figure 13:
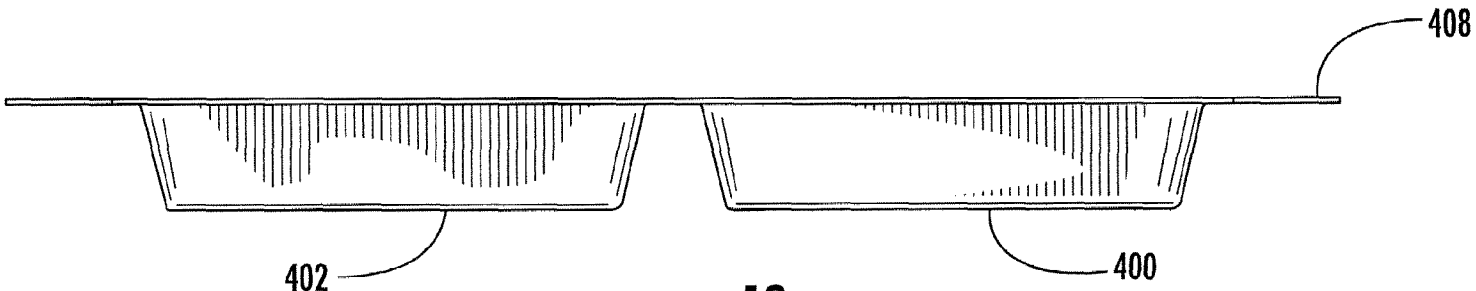
FIG. 13 is a front elevation view of the packaging container of FIG. 12.

Referring now to FIGS. 12 and 13, another embodiment of the present invention shows a pair of trays 400, 402 hingedly connected together about a scored line 404. The package may also include a strip 406 having a hole or slot 408 extending therethrough that is sized to enable the sealed trays to be placed onto a rod or peg board hook (not shown) at the point of sale for sale or display.

Each of the trays in one embodiment is made from a substantially opaque material of the type known to protect against tearing or tampering. The tray thereby acts to prevent consumers from seeing the product, as well as preventing undesired removal of the product from the package prior to purchase. An example of such a material is a SBS board coated on both sides with a directional material such as VALERON™ such that the grains criss-cross to add strength to the tray. It is also appreciated that the tray may comprise two layers of SBS board that are coated with a laminated material having directional grains so that when the two layers are placed on top of one another, the grains overlap. The criss-cross grains of the material add strength to the tray and protect against tearing or tampering in two directions. A suitable coating is manufactured under the trademark VALERON™ by Valeron Strength Films. While VALERON is made from a polyethylene material, other such coatings such as, but not limited to, polypropylene or polyester may be used. Another example of a suitable coating or laminate is PLA (corn oil plastic). The trays also preferably include a heat seal coating to permit the rims or flanges 410, 412 of the trays 400, 402 to be securely held together while providing sealed edges to house the products for storage and display.

While a SBS board with a cross-laminated coating is preferred, it is appreciated that other materials having sufficient strength to resist tearing including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF. It is also appreciated that the trays may be made from a paper product already having a reinforced layer material (e.g., VALERON) applied or adhered thereto prior to formation into a tray.

Figure 14:
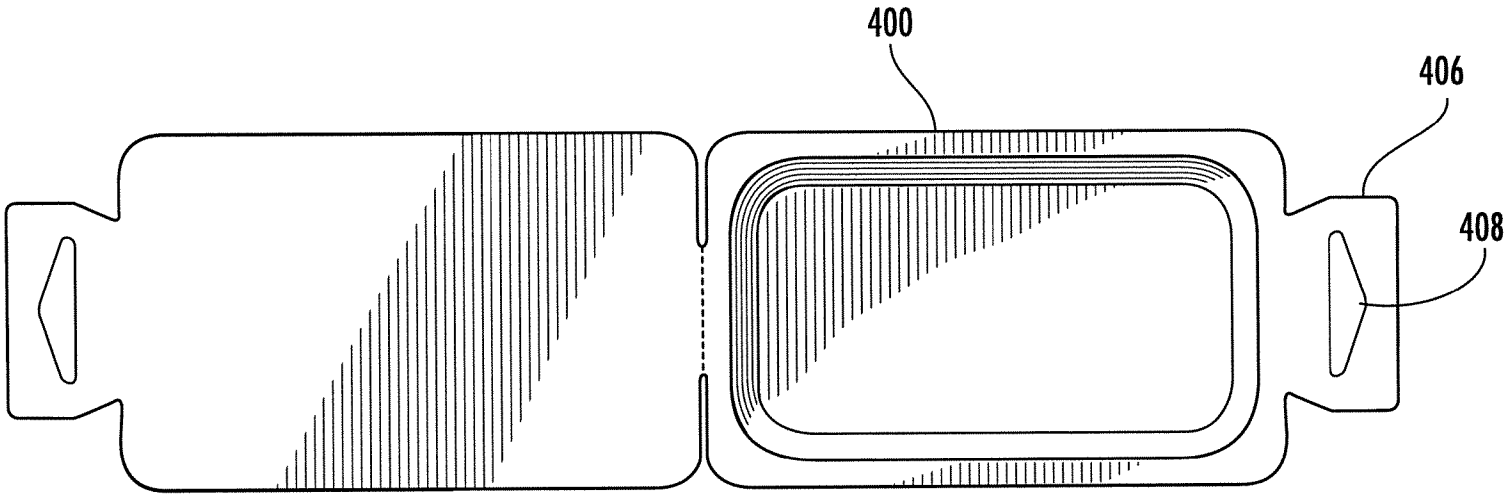
FIG. 14 is a top plan view of an embodiment of a packaging container having one tray.
Figure 15:
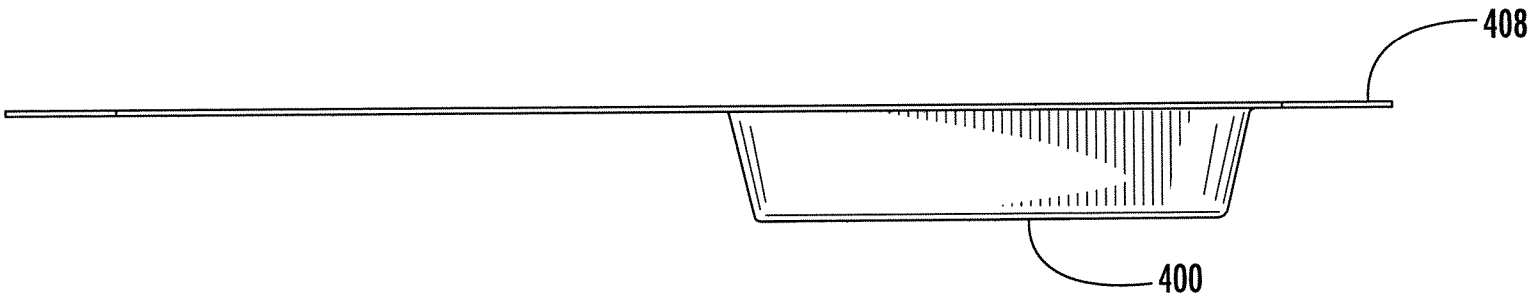
FIG. 15 is a front elevation view of the packaging container of FIG. 14.

Referring now to FIGS. 14 and 15, it is appreciated that the packaging container may only have one tray 400 that is hingedly connected to a flat sheet, card or blank. Further, it is appreciated that the tray and the flat sheet may be manufactured separately and attached together. It is appreciated that the tray 400 is preferably a printable paper tray having a flange about the base of the chamber. The underside of the flange may be heat sealed or otherwise attached to the flat sheet or card in a known way. The flat sheet or card may be made from a paper material such as, but not limited to a paper stock, a paperboard or a corrugate layer. It is also appreciated that it may comprise a pair of paper layers or sheets attached together, wherein the sheets may include an outer tear resistant material such as, but not limited to, VALERON, applied thereto or thereon. The pair of paper layers also may include a corrugate layer or other firm insert attached or placed in between the sheets to increase the overall rigidity of the package. One or more additional trays may also be attached to the back side of the card to house additional products or parts.

Figure 16:
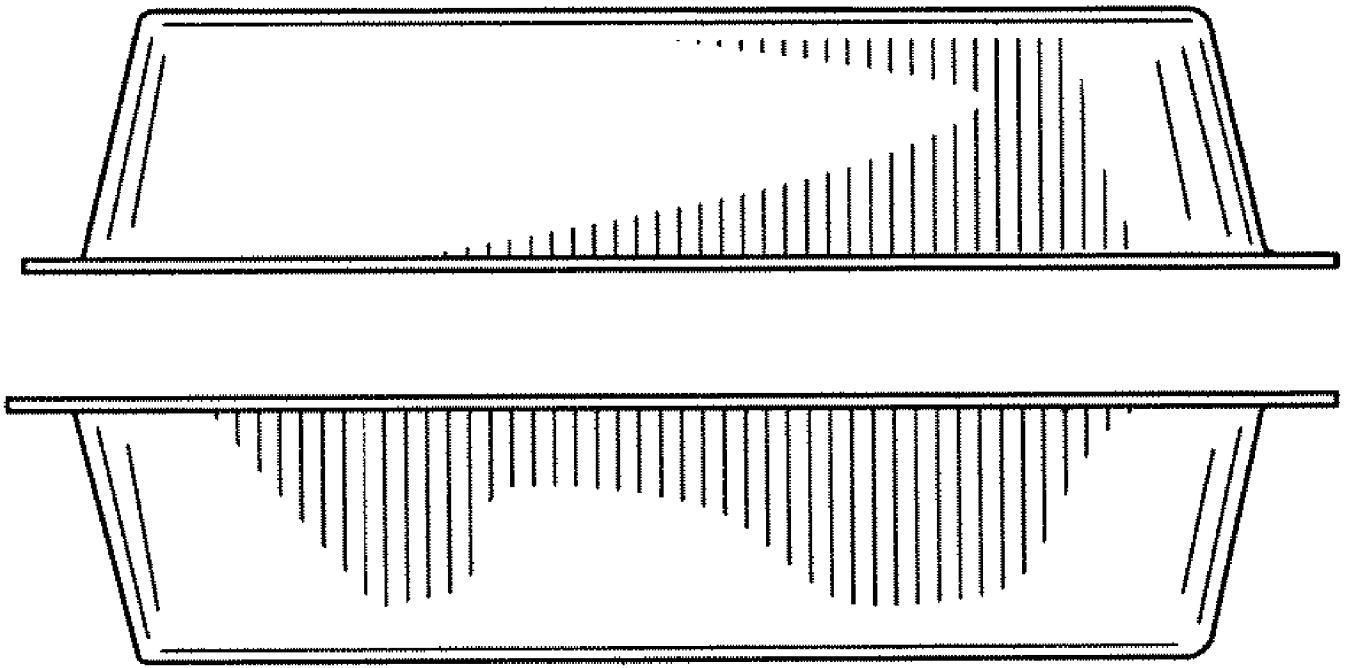
FIG. 16 is a front elevation view of a packaging container having two separate trays that may be connected together.

As shown in FIG. 16, it is also appreciated that the pair of trays may be manufactured separately (i.e., without a hinge) and not depart from the scope of the present invention.

It is also appreciated that the packaging may comprise a top formed paper tray with or without a tear-resistant coating or layer and one or more smaller trays extending through corresponding openings in a paper sheet or backing that is attached to the top paper tray in a known way, such as by heat sealing. The outer edges of the top tray may have flat flanges or raised regions to facilitate stacking in a nested fashion. Such nested stacking can be provided for by providing a concave bottom portion to receive the top portion of the package below it in a nested, stacked fashion. The smaller trays can be configured to protrude from either the front of the top tray and/or the back of the top tray or a separate back tray. Two or more smaller trays can be operably affixed to the top tray so as to provide multiple outwardly closed chambers for holding products without the need to use any plastic in the package for environmental reasons. The smaller trays may also be attached directly to the inside of the top paper tray in a known way. It is appreciated that the trays extending through the openings of the sheet may be made from a variety of materials including, but not limited to, plastic or molded, printable paper, depending on the desired characteristics of the package (e.g., if it is desired to see the contents) and not depart from the scope of the present invention. If made of paper, the trays may also include a tear-resistant outer layer or coating. If smaller trays are placed on opposite sides of the top tray, the smaller trays can be aligned open end to open end or offset with respect to each other.

It is further appreciated that the tray may also contain an electronic security device such as, but not limited to, a product sensor/transmitter that will set off an alarm to indicate that a consumer or customer may be passing a security sensor and thereby leaving the store with an unpurchased product. Such a sensor would be deactivated upon payment for the product at the point of purchase.

In order to gain access to the product or information contained within the tray, it is understood that the housing may be cut with scissors or a knife. Because of the material used for the housing, the resulting cut surfaces will be substantially free of sharp edges, thereby making the product package safer to use.

Figure 8:
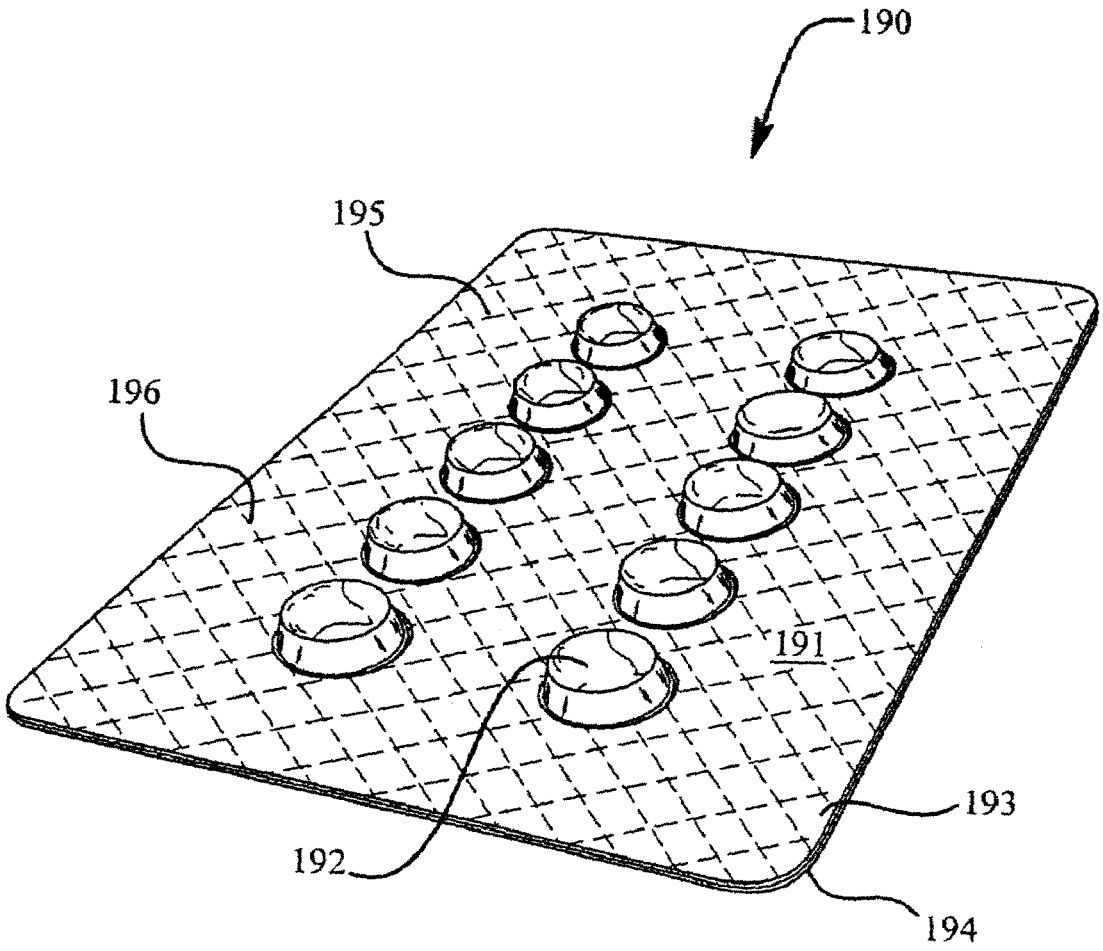
FIG. 8 is a perspective view of an embodiment of a blister pack providing criss-cross grain card material surrounding a plurality of blisters.

Turning to FIG. 8, an embodiment of a pill dispensing blister pack 190 is shown having a housing 191 and a plurality of blisters 192. The housing is preferably a criss-cross grain double layer card 191 that includes a top sheet 193 and a bottom sheet 194 that surround and retain a plurality of blisters 192. In the preferred embodiment, the housing is made from a SBS board coated on one side with a laminated material having directional grains so that when two housing sheets having grains 195 and 196 that extend in different directions are placed on top of one another such that the grains overlap in a criss-cross pattern. The criss-crossing grains of the materials add strength to the housing and protect against tearing or tampering in two directions. A suitable coating is manufactured under the trademark VALERON™ by Valeron Strength Films. While Valeron is made from a polyethylene material, other such coatings such as, but not limited to, polypropylene or polyester may be used. The material used also is preferably printable to allow for advertising, promotional or other information to be displayed on the housing. While a SBS board with a cross-laminated coating is preferred, it is appreciated that other materials having sufficient strength to resist tearing, including, but not limited to, cloth films, cloth and plastic films, heat sealable boards and other coatings, also may be used and not depart from the scope of the present invention. Examples of cloth films and cloth and plastic films include those films sold under the names SCRIMM and CLAFF.

Similar to the packaging containers described above, the blisters preferably include a rim about their bottom that interacts with the housing sheets to secure the blister in place. While the blister pack is shown as having ten substantially round blisters, it is appreciated that the blister pack may have any number of blisters of varying shapes and not depart from the scope of the present invention. A plurality of dispensing slots are formed on the bottom of the card 191 and are covered with film or foil so that the pills contained in blisters 192 can be pushed through a thin film or foil sheet.

It will be understood that modifications and variations may be effected without departing from the scope of the novel concepts of the present invention, but it is understood that this application is limited only by the scope of the appended claims.

The invention claimed is:

1. A packaging container comprising:

a housing comprising:

a first portion;

a second portion attached to the first portion; and an opening in the first portion of the housing; and a substantially opaque tray substantially surrounded by and extending through the opening of the first portion of the housing and secured within the housing;

wherein the first portion is made from a substantially tear-resistant material having a grain aligned in substantially one direction and the second portion is made from a substantially tear-resistant material having a grain aligned in a direction relative to the grain of the first portion so as to result in a criss-cross pattern of grain when the first and second portions are placed together so as to provide resistance to tearing in multiple directions.

2. The packaging container of claim 1 wherein the second portion is fixedly attached to the first portion.

3. The packaging container of claim 1 wherein the first and second portions are made from a printable material.

4. The packaging container of claim 1 wherein the tray includes a flange that abuts against a side of the first portion of the housing when the tray extends through the housing to retain the tray within the housing.

5. The packaging container of claim 1 wherein the substantial tear resistant material is a SBS board coated with a polyethylene material.

6. The packaging container of claim 1 wherein the tray is made from a paper product.

7. The packaging container of claim 6 wherein the paper product comprises cardboard.

8. The packaging container of claim 6 wherein the paper product comprises corrugated paperboard.

9. The packaging container of claim 6 wherein the tray is made from a substantially tear-resistant material.

10. The packaging container of claim 9 wherein the paper product is coated with a polyethylene material.

11. The packaging container of claim 10 wherein the paper product comprises a SBS board.

12. The packaging container of claim 1 wherein the tray is substantially seamless.

13. The packaging container of claim 1 wherein the tray comprises an exterior, and wherein the tray includes graphics on the exterior.

14. The packaging container of claim 1 which further comprises a slot extending through the first and second portions of the housing for use in displaying one or more products contained within the packaging container.

15. A package for at least one or more of products or objects comprising:

a housing comprising:

a first portion made from a substantially tear-resistant material having grain aligned in a first direction;

a second portion attached to the first portion and made from a substantially tear-resistant material having grain aligned in a second direction substantially relative to the grain of the first portion so as to result in a substantially criss-cross pattern of grain when the first and second portions are placed together so as to provide resistance to tearing in multiple directions; and an opening in the first portion of the housing; and a substantially opaque tray substantially surrounded by the opening of the first portion of the housing, wherein the tray includes a flange that abuts against the underside of the first portion of the housing when the tray is substantially surrounded by the first portion to secure the tray with respect to the housing, and wherein the tray is substantially seamless and made from a paper product that is printable.

16. The packaging container of claim 15 wherein the second portion comprises an opening and wherein the packaging container comprises a second tray substantially surrounded by and extending through the opening of the second portion of the housing and secured within the housing.

17. The packaging container of claim 16 wherein the second container is substantially opaque.

18. The packaging container of claim 16 wherein the second container is substantially transparent.

19. The packaging container of claim 15 which further comprises an insert card for placement between the first and second portions of the housing.

20. The packaging container of claim 19 wherein the insert card is a single sided corrugate adhered to one of the first and second portions of the housing.

21. The packaging container of claim 19 wherein the insert card comprises an outer portion and one of the first and second portions comprises fold-over edges for engaging the outer portion and maintaining the insert card therein.

22. A method for manufacturing a packaging container for holding product comprising the steps of:

providing at least one blank comprised of a material that is printable and substantially opaque;

printing graphics on the blank;

forming the blank into at least a first tray having a chamber for holding the product;

providing a housing comprising a first portion having an opening therein and a second portion, wherein the first portion is made from a substantially tear-resistant material having a grain aligned in substantially one direction substantially tear-resistant material and the second portion is made from a substantially tear-resistant material having a grain aligned in a direction relative to the grain of the first portion so as to result in a criss-cross pattern of grain when the first and second portions are placed together so as to provide resistance to tearing in multiple directions;

aligning the first tray so that a portion of the first tray extends through the opening of the first portion of the housing;

attaching the second portion of the housing to the first portion of the housing so that the first tray is securely fixed within the housing.

23. The method of claim 22 wherein the material for the blank is a paper product.

24. The method of claim 22 wherein the first tray comprises a flange that abuts against a side of the first portion of the housing when the first tray extends through the housing to retain the first tray within the housing.

* * * * *